US010378249B1

(12) United States Patent
Lee

(10) Patent No.: US 10,378,249 B1
(45) Date of Patent: Aug. 13, 2019

(54) MOBILE DEVICE LOCK

(71) Applicant: ABA UFO International Corp., New Taipei (TW)

(72) Inventor: Miko Lee, New Taipei (TW)

(73) Assignee: ABA UFO International Corp., New Taipei (TW)

( * ) Notice: Subject to any disclaimer, the term of this patent is extended or adjusted under 35 U.S.C. 154(b) by 46 days.

(21) Appl. No.: 15/878,468

(22) Filed: Jan. 24, 2018

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
CPC ... E05B 73/00; E05B 73/0082; E05B 73/0005
USPC ..... 70/58, 423, 424, 427–430
See application file for complete search history.

(56) References Cited

U.S. PATENT DOCUMENTS 5,913,907 A * 6/1999 Lee ..... E05B 73/0005 248/551
6,094,949 A * 8/2000 Lagerberg ..... E05B 73/0005 292/283
6,401,502 B1 * 6/2002 Yang ..... E05B 67/003 70/14
6,449,992 B1 * 9/2002 Yu ..... E05B 73/0082 70/23
6,463,770 B1 * 10/2002 Lee ..... E05B 73/0082 70/14
6,523,373 B1 * 2/2003 Su ..... E05B 73/0005 70/28
7,428,834 B1 * 9/2008 Lee ..... E05B 67/36 439/133
9,137,911 B2 9/2015 Avganim
9,187,934 B1 * 11/2015 Lee ..... E05B 73/0005
9,549,476 B2 1/2017 Avganim
9,624,697 B1 4/2017 Avganim
9,784,019 B2 10/2017 Avganim
2003/0106349 A1 * 6/2003 Broadbridge ..... E05B 73/0005 70/58
2004/0168486 A1 * 9/2004 Ling ..... E05B 73/0082 70/58
2006/0112740 A1 * 6/2006 Merrem ..... E05B 73/0082 70/58
2007/0169523 A1 * 7/2007 Lu ..... E05B 73/0082 70/58
2008/0034816 A1 * 2/2008 Lu ..... E05B 73/0082 70/58
2013/0180295 A1 7/2013 Avganim
(Continued)

FOREIGN PATENT DOCUMENTS

CN 201125602 Y 10/2008
CN 201133163 Y 10/2008
(Continued)

*Primary Examiner* — Suzanne L Barrett
(74) *Attorney, Agent, or Firm* — Alan D. Kamrath; Mayer & Williams PC

(57) ABSTRACT

A mobile device lock has a main body, a lock body, and a fastening set. The lock body and the fastening set are respectively mounted to the main body. The fastening set may move relative to the main body when the fastening set is inserted into a cavity of a mobile device, two sliding blocks of the fastening set fill the cavity, and then the fastening set is engaged with the main body. Therefore, the mobile device can be locked without using any key.

16 Claims, 7 Drawing Sheets

(56) References Cited

U.S. PATENT DOCUMENTS

| | | | | |
|---|---|---|---|---|
| 2013/0340490 | A1* | 12/2013 | Wu | E05B 73/0082 70/58 |
| 2015/0059422 | A1* | 3/2015 | Kao | E05B 73/00 70/58 |

FOREIGN PATENT DOCUMENTS

| | | | |
|---|---|---|---|
| TW | I473931 | B | 2/2015 |
| TW | I550173 | B | 9/2016 |
| TW | M528354 | U | 9/2016 |
| TW | M545815 | U | 7/2017 |

* cited by examiner

MOBILE DEVICE LOCK

BACKGROUND OF THE INVENTION

1. Field of the Invention

The invention relates to a lock, and more particularly to a mobile device lock that is convenient to use.

2. Description of Related Art

Mobile devices such as lap top computers and tablets are more and more important in the modern life. A mobile device lock has become an indispensible item with which a user can lock the mobile device when the user has to temporary leave his or her seat in the library or the café.

TW patent No. 1473931 entitled "COMPUTER SECURITY LOCK HAVING TRAPEZOIDAL SECURITY SLOT" discloses a computer security lock that has a lock body and a cavity, and the cavity matches with the lock body in shape. The cavity is formed in a surface of an electronic device that has an anti-theft demand. The cavity communicates with the outside of the electronic device via an opening, and the cavity has a trapezoidal cross section.

The lock body has a locking element, a lock pin, a moving device, and a locking device. The locking element protrudes from the lock body and has a front area and a back area. A cross section of the front area is wider than a cross section of the back area. The front area of the locking element is inserted into the cavity. The lock pin is mounted in the cavity along the locking element. After the lock pin is inserted into the cavity, the lock pin and the locking element fill the cavity. The moving device is connected to the lock pin, and this can drive the lock pin to slide. The locking device is connected to the moving device, and a key can be applied to lock or unlock the locking device.

However, to lock or unlock the locking device requires the operation with the key, which is inconvenience in use. When the user needs to lock the mobile device, the user's mobile device cannot be locked without the key.

Furthermore, the key is engaged with the lock pin of the locking device to push the locking pin into the cavity and lock the lock body, and pull the lock body outward to release the locking device from the locked state. In the unlocked state, if the friction between the locking pin and the locking device and the cavity is greater than the friction between the key and the lock pin of the locking device, the key will be directly pulled out when a pulling force is applied to the key, resulting in that the locking device cannot be unlocked.

To overcome the shortcomings of the conventional mobile device lock, the present invention provides a mobile device lock to mitigate or obviate the aforementioned problems.

SUMMARY OF THE INVENTION

The main objective of the present invention is to provide a mobile device lock that is convenient to use.

The mobile device lock has a main body, a lock body, and a fastening set. The lock body and the fastening set are respectively mounted to the main body. The fastening set may move relative to the main body when the fastening set is inserted into a cavity of a mobile device, two sliding blocks of the fastening set fill the cavity, and then the fastening set is engaged with the main body. Therefore, the mobile device can be locked without using any key.

Other objects, advantages, and novel features of the invention will become more apparent from the following detailed description when taken in conjunction with the accompanying drawing.

DETAILED DESCRIPTION OF PREFERRED EMBODIMENT

Figure 1:
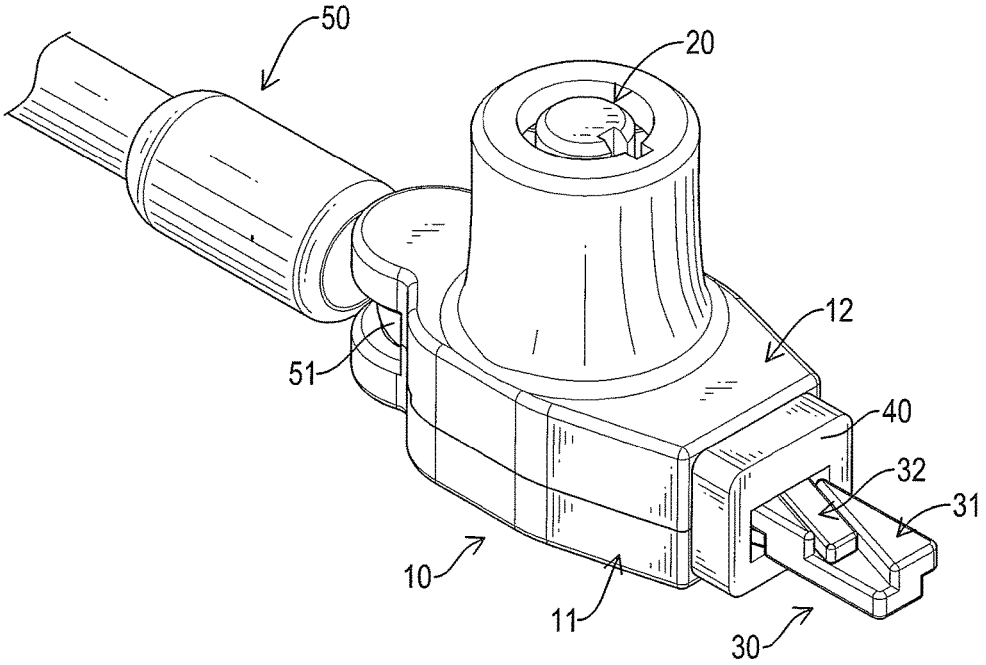
FIG. 1 is a perspective view of a mobile device lock in accordance with the present invention.
Figure 2:
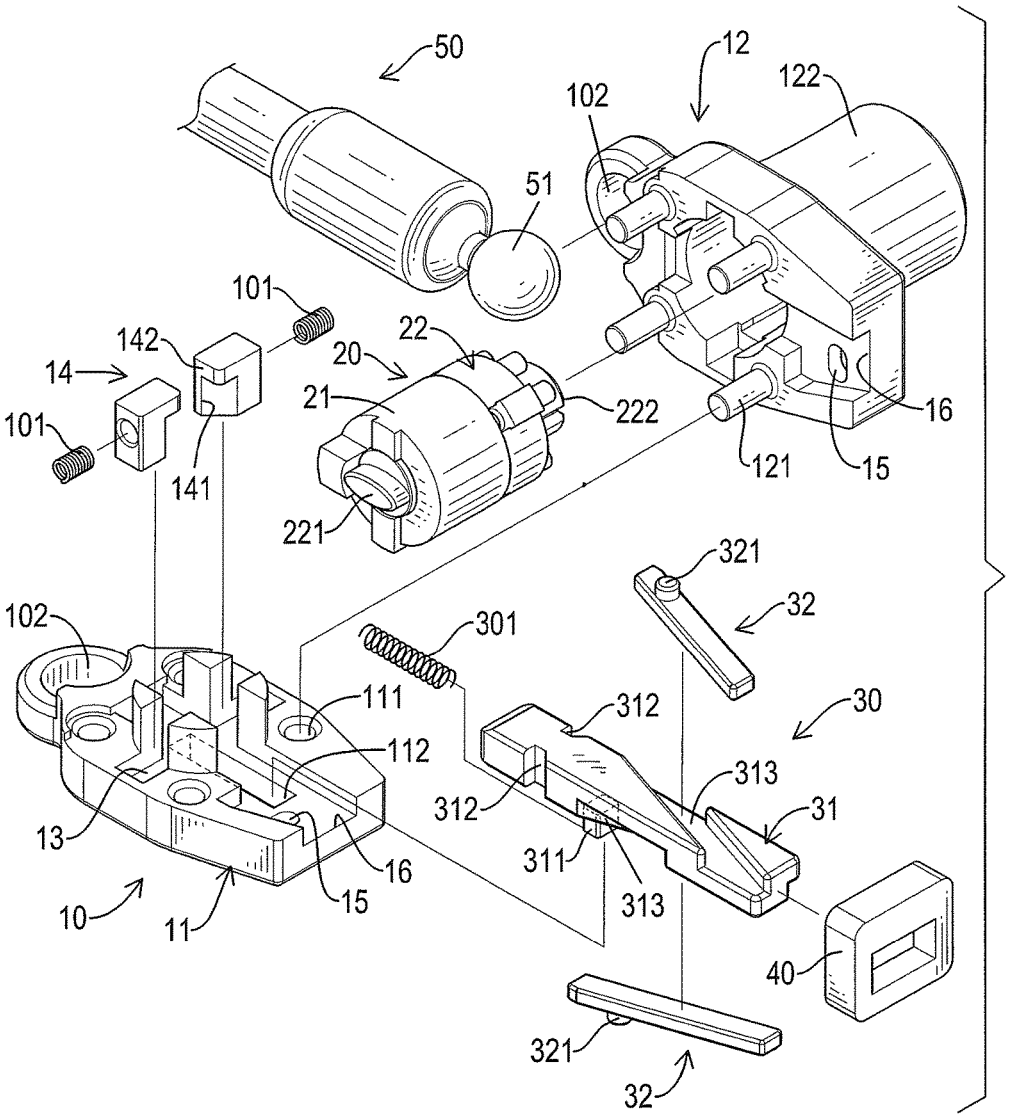
FIG. 2 is an exploded perspective view of the mobile device lock in FIG. 1.

With reference to FIGS. 1 and 2, a mobile device lock in accordance with the present invention comprises a main body 10, a lock body 20, a fastening set 30, and an elastic element 40.

The main body 10 has a lower cover 11, an upper cover 12, a receiving recess 13, at least one driven element 14, and at least one limiting recess 15. The lower cover 11 has multiple first combining portions 111 and a guiding groove 112. The first combining portions 111 are formed in a top surface of the lower cover 11 at spaced intervals. Preferably, the first combining portions 111 are positioning holes. The guiding groove 112 is formed in the top surface of the lower cover and between the first combining portions 111. Preferably, the guiding groove 112 extends along a longitudinal direction of the lower cover 11.

The upper cover 12 is combined with the lower cover 11 and is located above the lower cover 11. The upper cover 12 has multiple second combining portions 121 and a shell 122. The second combining portions 121 protrude from a bottom surface of the upper cover 12. Positions of the second combining portions 121 correspond respectively to positions of the first combining portions 111. A shape of each second combining portion 121 corresponds to a shape of a corresponding one of the first combining portions 111. The lower cover 11 is combined with the upper cover 12. Furthermore, an opening 16 is formed at one end of a connection edge of the lower cover 11 and the upper cover 12. The opening 16 communicates with an interior and an exterior of the main body 10. The shell 122 is formed on and protrudes from a top surface of the upper cover 12. A mounting space is formed inside the shell 122, and the mounting space communicates with a top end and a bottom end of the shell 122. The mounting space communicates with the interior and the exterior of the main body 10.

The receiving recess 13 is formed inside the main body 10. The receiving recess 13 is located at the connection edge of the lower cover 11 and the upper cover 12, is above the guiding groove 112, and is staggered with respect to guiding groove 112. Preferably, the at least one driven element 14 includes two driven elements 14 mounted in the receiving recess 13, and the two driven elements 14 are respectively located at two sides of the guiding groove 112. The two driven elements 14 abut two inner side walls of the receiving recess 13 with a force provided by an elastic piece 101, and may slide in the receiving recess 13. Each one of the two driven elements 14 has an inner face, a fastening portion 141, and an abutting edge 142. The inner faces of the two driven elements 14 face each other. Each fastening portion 141 and each abutting edge 142 are formed at the two inner faces of the driven elements 14. The two fastening portions 141 are adjacent to the lower cover 11. The two abutting edges 142 are adjacent to the upper cover 12.

Preferably, the two limiting recesses 15 are respectively formed in the lower cover 11 and the upper cover 12, and are adjacent to the opening 16.

The lock body 20 is mounted in the main body 10, and is inserted into the shell 122 of the upper cover 12. The lock body 20 has a lower ball mount 21 and an upper ball mount 22. The lower ball mount 21 is sleeve-shaped and is located at the lock body 20. The upper ball mount 22 is connected with the lower ball mount 21 via multiple plugs of different lengths and is away from the lower cover 11. The upper ball mount 22 has a first end, a second end, a cam 221, and a lock core 222. The cam 221 is mounted at the first end of the upper ball mount 22, and the first end of the upper ball mount 22 is mounted through the lower ball mount 21 and extends into the two abutting edges 142 of the two driven elements 14. The cam 221 is ellipsoidal in shape. The lock core 222 can match with a key 60, and the key 60 may push the plugs into the lower ball mount 21. The lock core 222 may drive the cam 221 to rotate by rotating the key 60, and then the upper ball mount 22 may rotate relative to the lower ball mount 21.

The fastening set 30 is connected with the main body 10 and is located below the lock body 20. The fastening set 30 is connected with the lock body 20 by the two driven elements 14. The fastening set 30 has a guiding board 31 and at least one sliding block 32. Preferably, the fastening set 30 has two sliding blocks 32. The guiding board 31 is slidably mounted in the lower cover 11 of the main body 10, and extends along the longitudinal direction of the lower cover 11. A guiding spring 301 is mounted in the lower cover 11. One end of the guiding board 31 extends out of the main body 10 via the opening 16. The guiding board 31 has a guiding block 311, two fastening grooves 312, and two sliding grooves 313. The guiding block 311 is formed on and protrudes from a middle section of a bottom surface of the guiding board 31 and extends toward the lower cover 11. The guiding block 311 is inserted into the guiding groove 112, and this makes the guiding board 31 slidable along the longitudinal direction of the lower cover 11. The guiding spring 301 is mounted between the guiding block 311 and an end of the guiding groove 112 that is away from the opening 16. The two fastening grooves 312 are formed in two side surfaces of the guiding board 31, and the positions of the two fastening grooves 312 correspond to each other. Shapes of the two fastening grooves 312 correspond to shapes of the fastening portions 141 of the two driven elements 14. The two sliding grooves 313 are respectively formed in a top surface and the bottom surface of the guiding board 31, and each one of the sliding grooves 313 has a first end and a second end. The first end of each sliding groove 313 communicates with the corresponding limiting recess 15. The two sliding grooves 313 are obliquely formed in the top surface and the bottom surface of the guiding board 31 and are staggered with respect to each other.

The two sliding blocks 32 are connected with the main body 10 and the guiding board 31. Each one of the two sliding block 32 is slidably mounted in a corresponding one of the sliding grooves 313, and the two sliding blocks 32 are respectively disposed on the top surface and the bottom surface of the guiding board 31. The two sliding blocks 32 are inserted into the main body 10 via the opening 16. Furthermore, each one of the two sliding blocks 32 has a limiting portion 321 formed at one end which is inserted into the main body 10. The limiting portion 321 is mounted in the corresponding limiting recess 15, and this limits the sliding position of the sliding blocks 32 along the sliding groove 313.

The elastic element 40 is a collar made of a foam material, and is disposed at the opening 16 of the main body 10. The elastic element 40 is mounted around an outer periphery of the fastening set 30 extending out of the opening 16.

Preferably, the lower cover 11 and the upper cover 12 each have a cable engaging portion 102, and the two cable engaging portions 102 are away from the opening 16 of the main body 10. The main body 10 can be connected with a cable 50 via the cable engaging portions 102. The two cable engaging portions 102 can be mounted with a connector 51 of the cable 50 when the lower cover 11 is mounted with the upper cover 12. The cable 50 may rotate relative to the connector 51, or may swing relative to the main body 10 via the connector 51.

Figure 3:
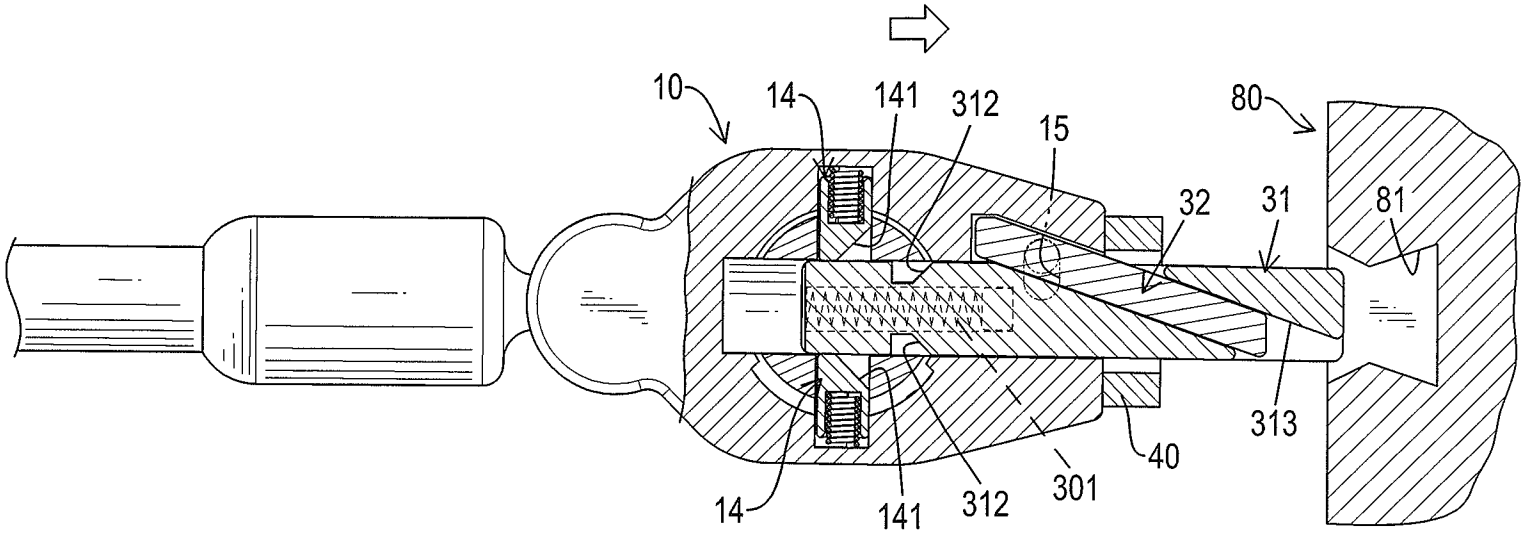
FIG. 3 is a cross sectional top view of the mobile device lock in FIG. 1.
Figure 4:
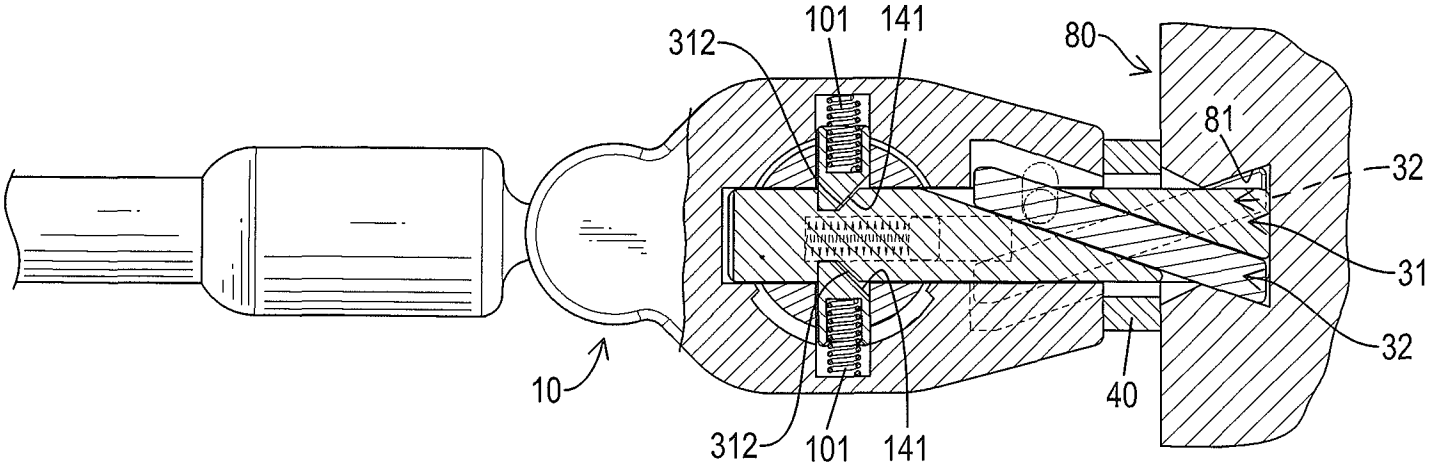
FIG. 4 is an operational cross sectional top view of the mobile device lock in FIG. 1.

With reference to FIGS. 3 and 4, when the mobile device lock in accordance with the present invention is in use with a mobile device 80 such as a laptop computer or tablet, the guiding board 31 is inserted into a cavity 81 of the mobile device 80, and this makes the guiding board 31 abut an inner face of the cavity 81. Therefore, the main body 10 is moved toward the guiding board 31 and abuts and compresses the guiding spring 301. When the two sliding blocks 32 are pushed by the guiding board 31, the limiting portion 321 may slide in the limiting recess 15 and move in the width direction relative to the main body 10. At the same time, front ends of the two sliding blocks 32 may slide along the two sliding grooves 313 and extend out of the guiding board 31, and fill the cavity 81 as shown in FIG. 4.

When the two sliding blocks 32 abut the inner face of the cavity 80, the two fastening grooves 312 of the guiding board 31 are located at the corresponding positions of the two driven elements 14. The fastening portions 141 of the two driven elements 14 match with the two fastening grooves 312 by pushing forces provided by the two elastic pieces 101, the position of the guiding board 31 is fixed, and this may lock the mobile device 80. At the same time, the elastic element 40 is between the main body 10 and an outer surface of the mobile device 80, and is compressed by the main body 10 and the mobile device 80.

Figure 5:
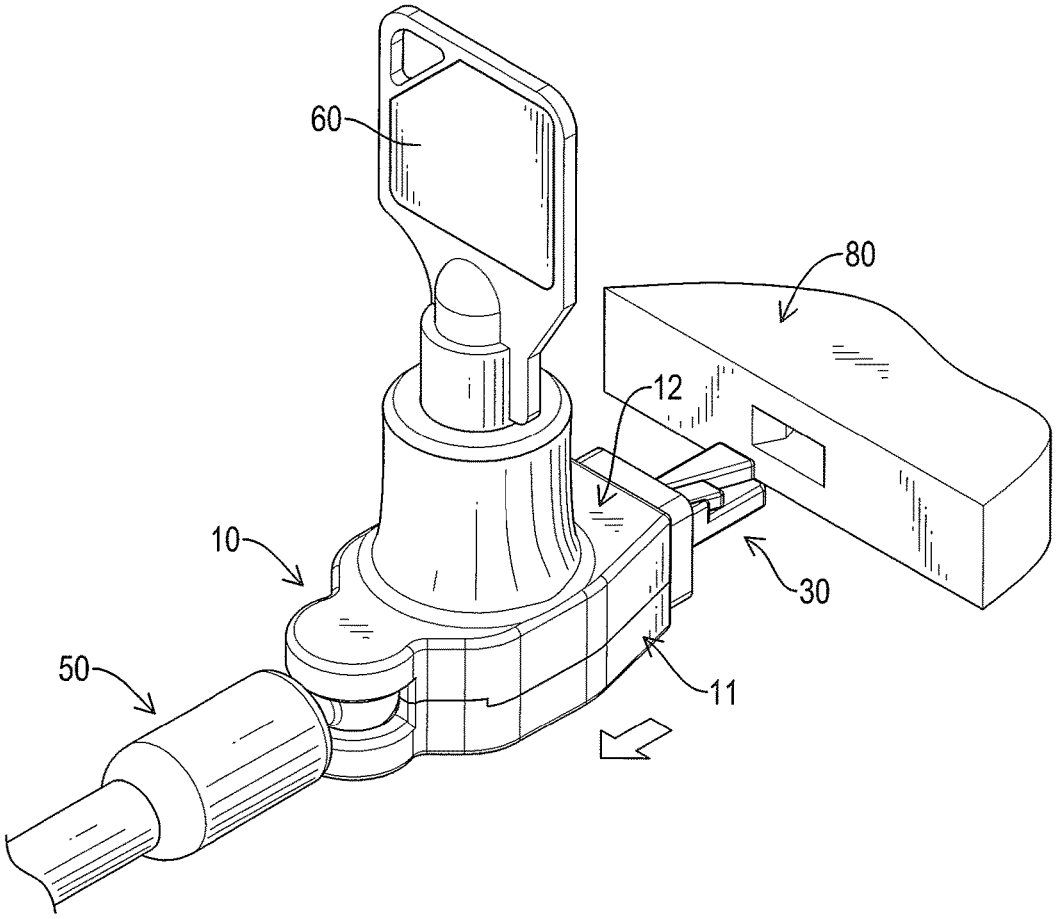
FIG. 5 is an operational perspective view of the mobile device lock in FIG. 1.
Figure 6:
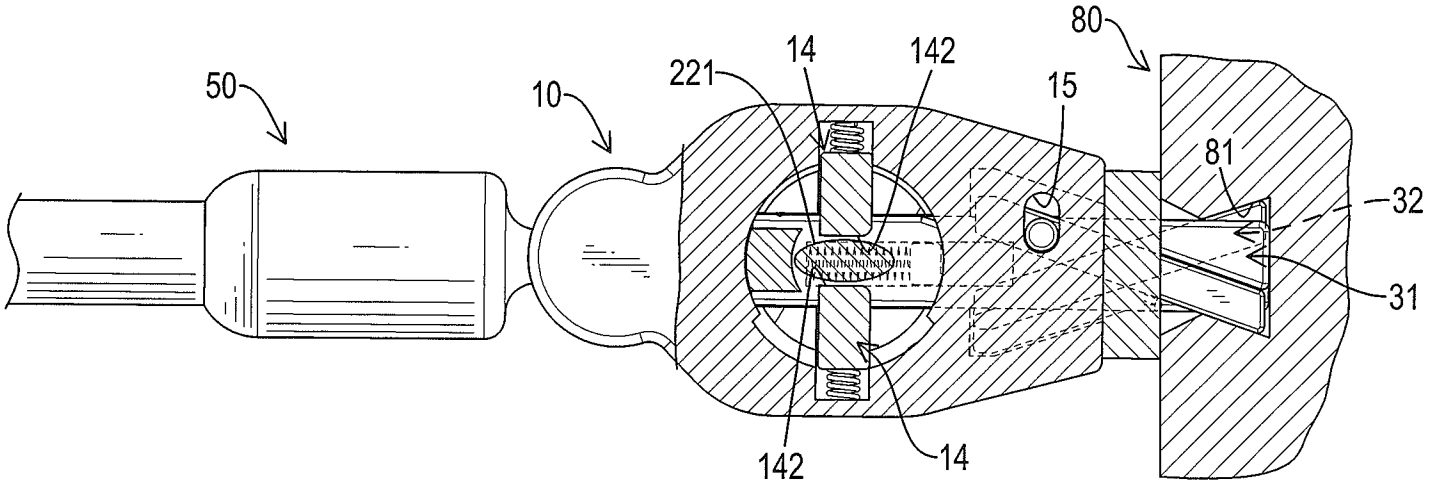
FIG. 6 and FIG. 7 are operational cross sectional top views of the mobile device lock in FIG. 1.
Figure 7:
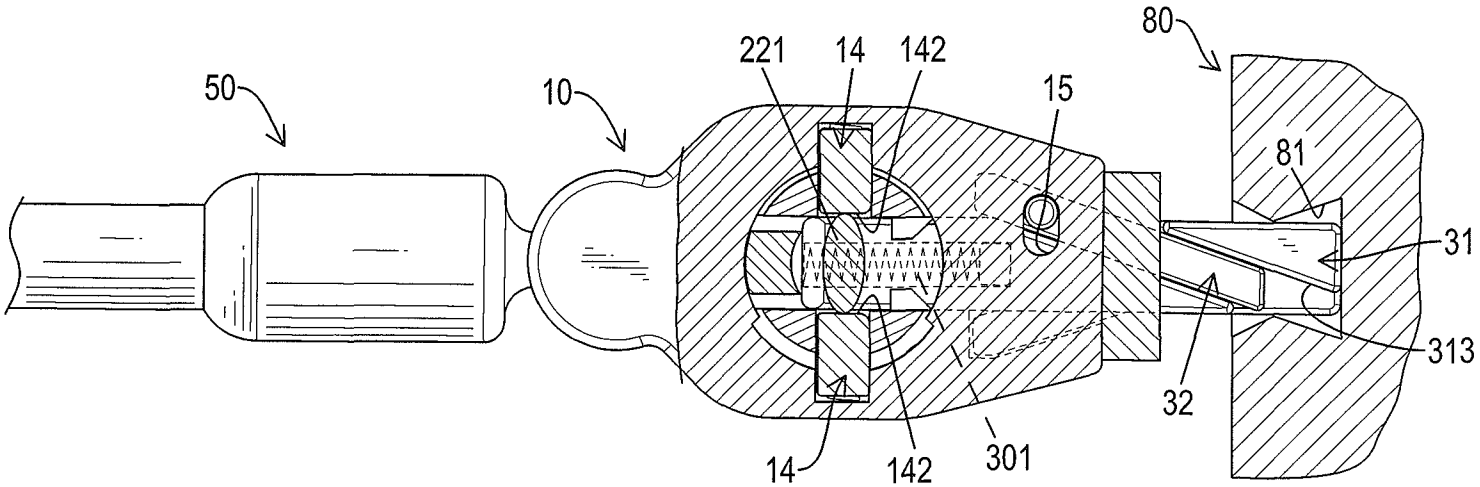

With reference to FIGS. 5 to 7, to unlock the mobile device 80, the key 60 is inserted into the main body 10 and match with the lock core 222. The key 60 is rotated and drive the lock core 222, and this rotates the cam 221 synchronously. The cam 221 abuts the abutting edges 142 of the two driven elements 14 after the cam 221 is rotated, and then the two driven elements 14 are separated. Furthermore, the two fastening portions 141 are disengaged from the two fastening grooves 312, and the restoring force of the guiding spring 301 moves the main body 10 away from the mobile device 80. The two sliding blocks 32 are disengaged from the cavity 81 to unlock the mobile device 80.

By means of the above technical features, the mobile device lock in accordance with the present invention enables the user to lock the mobile device 80 without using the key 60, which effectively improves the convenience of using the mobile device. Preferably, the elastic element 40 is disposed to provide a cushioning effect between the main body 10 and the mobile device 80 so as to prevent the main body 10 from hitting the mobile device 80 and causing scratches on the outer sidewall of the mobile device 80. In addition, when the fastening set 30 is in the locked state, the main body 10 and the mobile device 80 press the elastic element 40, and the restoring force of the elastic element 40 can enhance the engagement between the two sliding blocks 32 and the cavity 81. So the combination of the fastening set 30 and the cavity 81 is stable, thereby providing a mobile device that can achieve the locking effect in a simplified way.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile device lock comprising:

a main body having an opening formed at an end of the main body;

a receiving recess formed inside the main body;

at least one driven element movably mounted in the receiving recess, and each driven element having an abutting edge and a fastening portion; and at least one limiting recess formed inside the main body and being adjacent to the opening;

a lock body rotatably mounted in the main body and having a lock core located in the lock body; and a cam located adjacent to an interior of the main body, wherein the cam abuts the abutting edge of the at least one driven element when the lock body rotates relative to the main body; and a fastening set movably connected with the main body and having a guiding board movably mounted inside the main body, extending out of the main body via the opening, and having at least one fastening groove having a shape corresponding to a shape of the fastening portion of the at least one driven element; and at least one sliding groove communicating with the at least one limiting recess, and formed through the guiding board and obliquely extending to the opening; and at least one sliding block mounted to the main body and the guiding board and slidably mounted in the at least one sliding groove, and each one of the at least one sliding block having a limiting portion formed at one end of the main body.

2. The mobile device lock as claimed in claim 1, wherein the main body has a guiding groove, the guiding board has a guiding block protruding from a surface facing the guiding groove, the guiding block is inserted into the guiding groove, and a guiding spring is mounted between the guiding block and an inner face of the guiding groove.

3. The mobile device lock as claimed in claim 1, wherein the at least one driven element includes two driven elements disposed in the receiving recess and respectively located at two sides of the guiding board;

the at least one limiting recess includes two limiting recesses respectively located at two sides of the guiding board and staggered with respect to each other;

the at least one fastening groove includes two fastening grooves; and the at least one sliding groove includes two sliding grooves.

4. The mobile device lock as claimed in claim 2, wherein the at least one driven element includes two driven elements disposed in the receiving recess and respectively located at two sides of the guiding board;

the at least one limiting recess includes two limiting recesses respectively located at two sides of the guiding board and staggered with respect to each other;

the at least one fastening groove includes two fastening grooves; and the at least one sliding groove includes two sliding grooves.

5. The mobile device lock as claimed in claim 1, wherein the cam is ellipsoidal in shape.

6. The mobile device lock as claimed in claim 2, wherein the cam is ellipsoidal in shape.

7. The mobile device lock as claimed in claim 3, wherein the cam is ellipsoidal in shape.

8. The mobile device lock as claimed in claim 4, wherein the cam is ellipsoidal in shape.

9. The mobile device lock as claimed in claim 1, wherein the mobile device lock has an elastic element mounted around an outer periphery of the fastening set extending out of the opening.

10. The mobile device lock as claimed in claim 2, wherein the mobile device lock has an elastic element mounted around an outer periphery of the fastening set extending out of the opening.

11. The mobile device lock as claimed in claim 3, wherein the mobile device lock has an elastic element mounted around an outer periphery of the fastening set extending out of the opening.

12. The mobile device lock as claimed in claim 4, wherein the mobile device lock has an elastic element mounted around an outer periphery of the fastening set extending out of the opening.

13. The mobile device lock as claimed in claim 5, wherein the mobile device lock has an elastic element mounted around an outer periphery of the fastening set extending out of the opening.

14. The mobile device lock as claimed in claim 6, wherein the mobile device lock has an elastic element mounted around an outer periphery of the fastening set extending out of the opening.

15. The mobile device lock as claimed in claim 7, wherein the mobile device lock has an elastic element mounted around an outer periphery of the fastening set extending out of the opening.

16. The mobile device lock as claimed in claim 8, wherein the mobile device lock has an elastic element mounted around an outer periphery of the fastening set extending out of the opening.

* * * * *